US008117472B2

(12) United States Patent
Koyata

(10) Patent No.: US 8,117,472 B2
(45) Date of Patent: Feb. 14, 2012

(54) SEMICONDUCTOR DEVICE

(75) Inventor: Yasushi Koyata, Kanagawa (JP)

(73) Assignee: Renesas Electronics Corporation, Kawasaki-shi, Kanagawa (JP)

( * ) Notice: Subject to any disclaimer, the term of this patent is extended or adjusted under 35 U.S.C. 154(b) by 532 days.

(21) Appl. No.: 12/216,671

(22) Filed: Jul. 9, 2008

(65) Prior Publication Data

US 2009/0019297 A1 Jan. 15, 2009

(30) Foreign Application Priority Data

Jul. 10, 2007 (JP) ..... 2007-181020

(51) Int. Cl.
*G06F 1/26* (2006.01)
*G06F 1/32* (2006.01)

(52) U.S. Cl. ..... 713/320; 713/323

(58) Field of Classification Search ..... 713/300, 713/310, 320, 321, 322, 323, 324, 330, 340
See application file for complete search history.

(56) References Cited

U.S. PATENT DOCUMENTS

| | | | | |
|---|---|---|---|---|
| 5,483,464 | A * | 1/1996 | Song | 713/300 |
| 5,864,336 | A * | 1/1999 | Yano | 713/321 |
| 6,301,671 | B1 * | 10/2001 | Boice et al. | 713/322 |
| 6,657,634 | B1 * | 12/2003 | Sinclair et al. | 345/534 |
| 7,155,625 | B2 * | 12/2006 | Cohen et al. | 713/340 |
| 7,184,035 | B2 * | 2/2007 | Sato et al. | 345/213 |
| 7,356,726 | B2 * | 4/2008 | Shimoyama et al. | 713/600 |
| 7,424,629 | B2 * | 9/2008 | Cioaca | 713/300 |
| 7,698,574 | B2 * | 4/2010 | Morimoto et al. | 713/300 |
| 2007/0050651 | A1 | 3/2007 | Cioaca | |
| 2008/0222433 | A1 * | 9/2008 | Kim | 713/300 |

FOREIGN PATENT DOCUMENTS

| | | |
|---|---|---|
| JP | 2003-108056 | 4/2003 |
| JP | 2003-255904 | 9/2003 |
| JP | 2004-272270 | 9/2004 |

OTHER PUBLICATIONS

Japanese translation of a Chinese Office Action dated Mar. 21, 2011 with an English translation.

* cited by examiner

*Primary Examiner* — Mark Rinehart
*Assistant Examiner* — Trisha Vu
(74) *Attorney, Agent, or Firm* — McGinn IP Law Group, PLLC

(57) ABSTRACT

Semiconductor device reduces power consumption of total display system. A display memory 12 is operated by a power RVDD and stores display data WD at a determined timing based on various signals from a logic section 11. The display memory 12 outputs the stored display data WD as display data RD to a source driver 15 based on the various signals from the logic section 11. A bias circuit 14 detects a memory write signal MAW and a memory read signal MAR of the logic section 11 to the display memory 12 and controls bias of a power section for memory 13*a* based on detected result. The power section for memory 13*a* is configured by an analog amplifier and steps down voltage of a power terminal VCC and keeps constant and supplies the constant voltage as the power RVDD to the display memory 12. A driving capacity of the power section for memory 13*a* can be varied by changing a bias current by controlling the bias circuit 14.

11 Claims, 6 Drawing Sheets

FIG. 3

| | MEMORY WRITING | MEMORY READING | BIAS CURRENT |
|---|---|---|---|
| STANDBY PERIOD | NO | NO | MINIMUM |
| DISPLAYING STILL PICTURES | NO | YES | LOW (MIDDLE) |
| DISPLAYING MOVING PICTURES | YES | YES | HIGH |
| CHANGING DISPLAYED PICTURES (NO-DISPLAYING PERIOD) | YES | NO | MIDDLE (LOW) |
| CHANGING DISPLAYED PICTURES (DISPLAYING PERIOD) | YES | YES | HIGH |

FIG. 6

| | MEMORY WRITING | MEMORY READING | RVDD VOLTAGE |
|---|---|---|---|
| STANDBY PERIOD | NO | NO | MINIMUM |
| DISPLAYING STILL PICTURES | NO | YES | LOW (MIDDLE ) |
| DISPLAYING MOVING PICTURES | YES | YES | HIGH |
| CHANGING DISPLAYED PICTURES (NO-DISPLAYING PERIOD) | YES | NO | MIDDLE (LOW) |
| CHANGING DISPLAYED PICTURES (DISPLAYING PERIOD) | YES | YES | HIGH |

SEMICONDUCTOR DEVICE

REFERENCE TO RELATED APPLICATION

This application is based upon and claims the benefit of the priority of Japanese patent application No. 2007-181020, filed on Jul. 10, 2007, the disclosure of which is incorporated herein in its entirety by reference thereto.

TECHNICAL FIELD

This invention relates to a semiconductor device, and particularly relates to a semiconductor device comprising a display memory and a logic circuit for the display memory.

BACKGROUND

It is a common requirement to reduce the electric power consumption for a liquid crystal display device used for a portable device such as a mobile phone because a battery is used for such a device. Therefore various kinds of methods for reduction of the electric power consumption have been developed and are disclosed in, for example, Patent Documents 1, 2 and 3.

Patent Document 1 discloses a display device provided with a switch group for distributing (demultiplexing) column voltages to be outputted from a column driving circuit and for outputting the demultiplexed column voltages to column electrodes of a pixel part, wherein non-overlap periods when all of control signals of switches becomes 'low' are provided to the display device and the timing of respective signals are stipulated so that the column voltages are changed in these periods. According to the device, the column voltages are changed in a state when the switches of the group are all in OFF state. Thus, a phenomenon in which a previous column voltage is once applied on the column electrodes is avoided and then the unnecessary voltage fluctuation is prevented and the increasing of the power consumption can be avoided in the display device.

Patent Document 2 discloses a display memory, a driver circuit, and a liquid crystal display device using the driver circuit which reduce the power consumption and enable quick plotting and eliminate a need of memory mapping. According to the display memory, the driver circuit, and the liquid crystal display device using the driver circuit, because the display memory is provided with two lines of read ports and one line of write port at both bit lines of the memory, a cell size can be greatly reduced compared to a case using a memory of normal dual ports and wiring resources and corresponding power consumption can be reduced.

Patent Document 3 discloses a driving device for a liquid crystal display device which can prevent consumption of unnecessary power by determining whether an image to be displayed is a moving image or a still image, and in the case of the still image, controlling supply of power to be applied to a memory which does not perform practical operation or other related devices.

[Patent Document 1]

JP Patent Kokai Publication No. JP-P2003-255904A

[Patent Document 2]

JP Patent Kokai Publication No. JP-P2003-108056A

[Patent Document 3]

JP Patent Kokai Publication No. JP-P2004-272270A

SUMMARY OF THE DISCLOSURE

Following analysis is based on the present invention.

The entire disclosures of Patent Documents 1 to 3 are incorporated herein by reference thereto.

By the way, a conventional power supply device for a memory of a display device keeps a bias current and power voltage constant regardless of an access state to the memory. As a result, the power consumption for memory power to supply the power to the display memory becomes large and consequently there is a problem that total power consumption of the total display system becomes large.

Because the display device is accessed periodically to the memory, no failure of the memory operation is expected if the power is supplied when the memory is accessed. Even if the power is reduced during a period of no access to the memory, the memory can be readily in operation state because the memory can keep the state before the power is reduced. And also, when reading the memory, the smaller power consumption (current) is necessary for operation compared to the case when writing the memory. The present invention founds on the features of the display memory of the display device.

In one aspect of the present invention, there is provided a semiconductor device which comprises a display memory and a logic circuit to control the display memory. A power circuit is provided to supply power to the display memory independently from a power supply for the logic circuit. A driving capacity of the power circuit is configured to vary in response to an access state of the logic circuit to the display memory.

The meritorious effects of the present invention are summarized as follows. According to the present invention, the power consumption of total display system including the display memory can be reduced because the driving capacity of the power can be varied in response to the state of the access to the display memory.

BRIEF DESCRIPTION OF THE DRAWINGS

In the accompanying drawings:

FIG. 3 is a table showing an access state of a memory and a bias current at each operation state of a first example of a semiconductor device of the present invention.

FIG. 6 is a table showing an access state of a memory and a bias current at each operation state of a second example of a semiconductor device of the present invention.

PREFERRED MODES OF THE INVENTION

A semiconductor device according to an exemplary embodiment of the present invention comprises a display memory and a logic circuit to control the display memory. The semiconductor device also comprises a power circuit to supply electric power to the display memory separately from a power source for the logic circuit. A driving capacity of the power circuit is configured to vary in response to an access state of the logic circuit to the display memory.

It is advantageous that the power circuit decreases (steps down) a bias current when the display memory is not accessed compared to the case when the display memory is accessed.

A bias circuit is preferably provided which detects the access signals of the logic circuit to the display memory and controls a bias of the power circuit based on a result of the detection of the access signals.

In addition, it is advantageous that the power circuit decreases (steps down) a power voltage to the display memory when the display memory is not accessed compared to a case when the display memory is accessed.

A voltage selection circuit is preferably provided which detects the access signals to the display memory and controls the power voltage of the power circuit based on a result of the detection of the access signals.

According to the semiconductor device having features above explained, the driving capacity of the power circuit varies in response to the access state of the logic circuit to the display memory. Therefore, the power consumption of the total display system including the display memory can be reduced.

Several examples are explained with reference to the drawings.

Example 1

Figure 1:
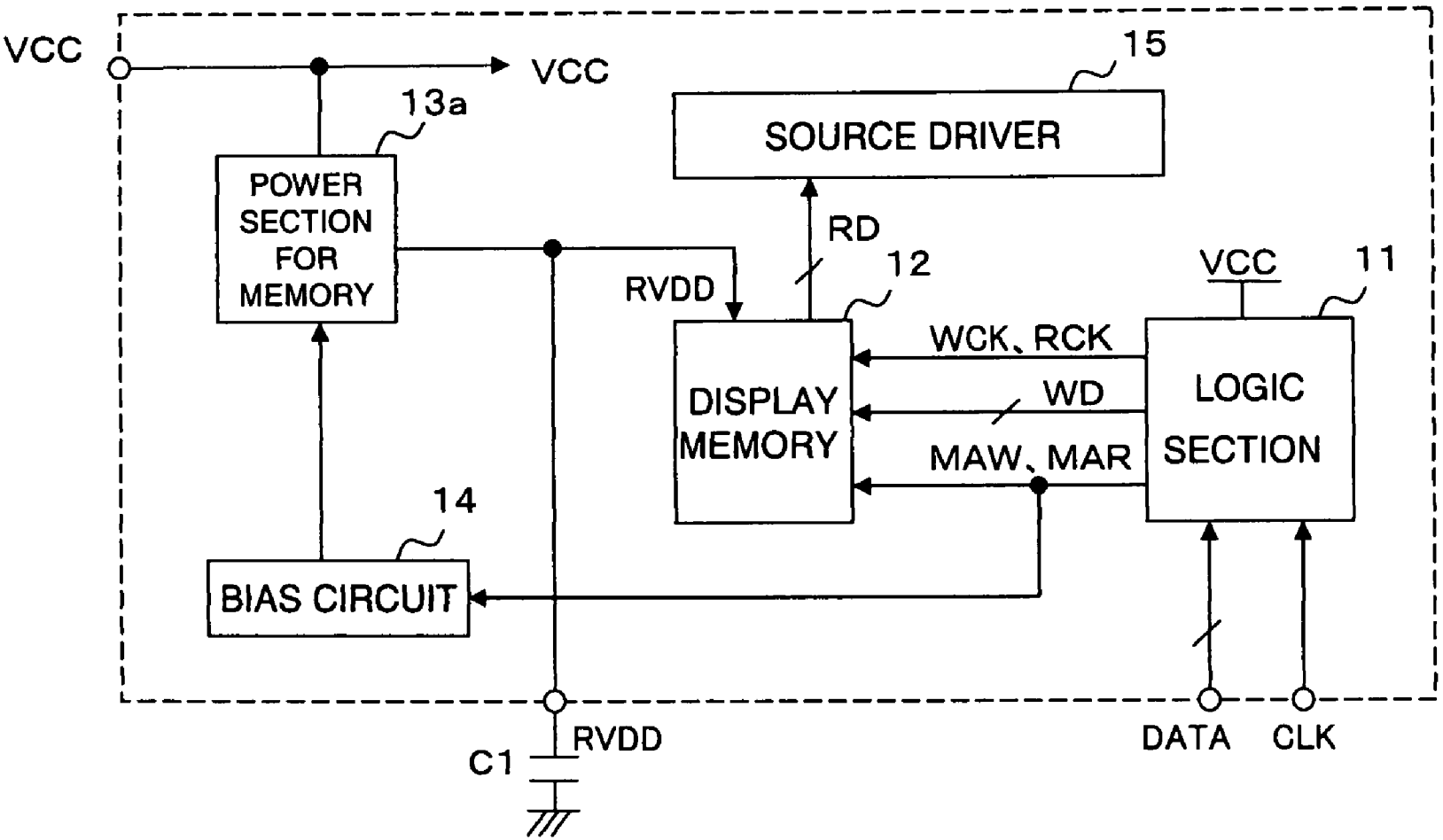
FIG. 1 is a schematic structural block diagram of a first example of a semiconductor device of the present invention.

FIG. 1 is a schematic structural block diagram of a first example of a semiconductor device of the present invention. The semiconductor device in FIG. 1 comprises a logic section 11, a display memory 12, a power section for memory 13*a*, a bias circuit 14 and a source driver 15.

The logic section 11 is operated by a power VCC to receive a clock signal from a terminal CLK and receive display data from a terminal DATA. And the logic section 11 generates a memory write clock WCK, a memory read clock RCK, a display data WD, a memory write signal MAW and a memory read signal MAR and outputs these clocks, data and signals to the display memory 12. The logic section 11 also outputs the memory write signal MAW and the memory read signal MAR to the bias circuit 14.

The display memory 12 is operated by a power RVDD and stores the display data WD at a determined timing based on the various kinds of signals from the logic section 11. The display memory 12 also outputs the stored display data WD to the source driver 15 as a display data RD based on the various signals from the logic section 11.

The bias circuit 14 detects the memory write signal MAW and the memory read signal MAR of the logic section 11 to the display memory 12 and controls the bias of the power section for memory 13*a* based on the results of the detection.

The power section for memory 13*a* is configured by an analog amplifier to step down the voltage of the power VCC and keeps constant and supply the constant voltage to the display memory 12 as the power RVDD. The driving capacity of the power section for memory 13*a* can be varied by changing the bias current by the control of the bias circuit 14. A capacitor C1 is connected to the external of the power RVDD via a terminal to reduce or eliminate a fluctuation or noises of the voltage of the power RVDD.

The source driver 15 drives sources of transistors (TFT, for example) for pixels in a liquid crystal panel (not shown) based on the display data RD.

Figure 2:
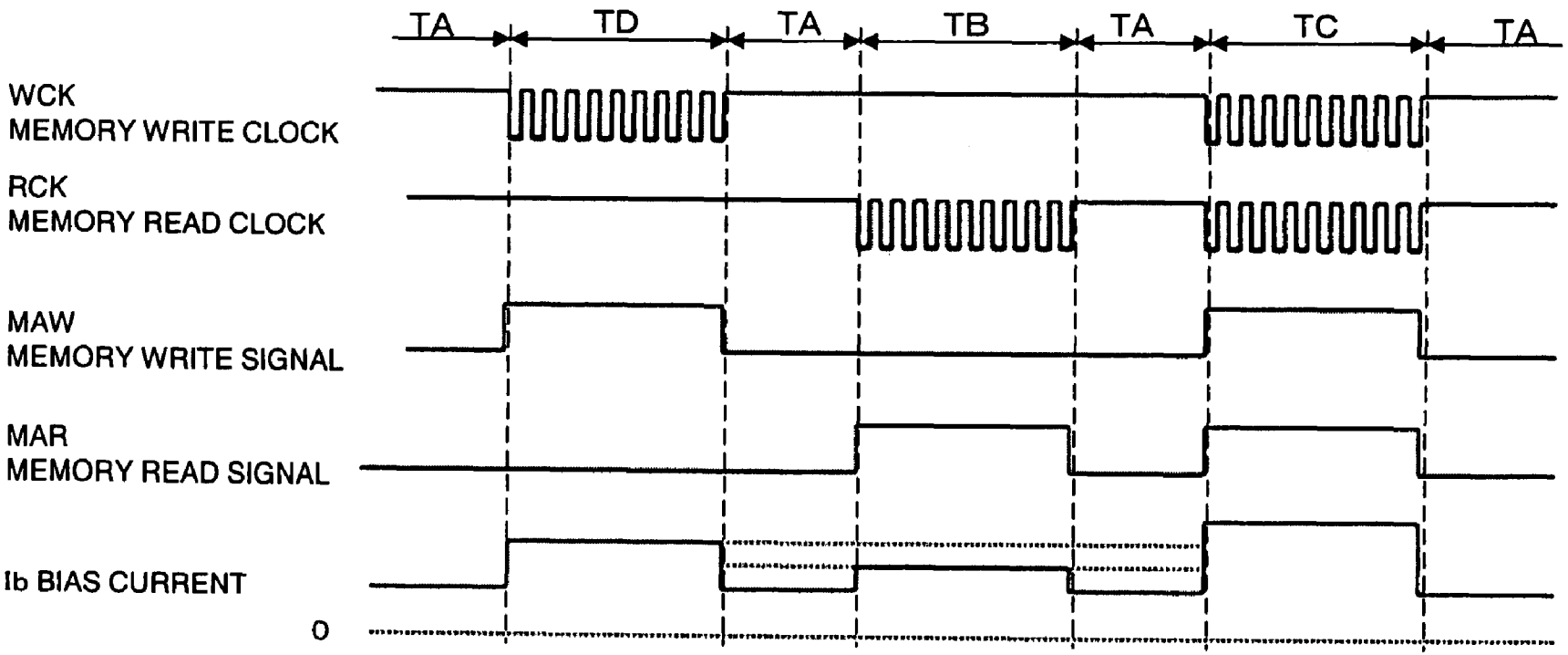
FIG. 2 is a timing chart showing an operation of a first example of a semiconductor device of the present invention.

Next, an operation of the semiconductor device is explained. FIG. 2 is a timing chart showing an operation of a first example of a semiconductor device of the present invention. FIG. 3 is a table showing access states to the memory and the bias current at each operation state of a first example of a semiconductor device of the present invention.

The bias circuit 14 sets the bias current of the power section for memory 13*a* at a "minimum" level when the display memory 12 is during standby, that is, all of the memory write clock WCK, memory write signal MAW, memory read clock RCK and memory read signal MAR are not inputted to the display memory 12 (the period indicated as TA in FIG. 2) as shown in FIGS. 2 and 3.

When the display memory 12 is displaying a still picture, that is, when the memory read clock RCK and the memory read signal MAR are inputted to the display memory 12 (the period indicated as TB in FIG. 2), the bias current of the power section for memory 13*a* is set at a "low" level.

On the other hand, when the display memory 12 is displaying moving pictures or at a time of changing displayed pictures (and during displaying period), that is, when all of the memory write clock WCK, memory write signal MAW, memory read clock RCK and memory read signal MAR are inputted to the display memory 12 (the period indicated as TC in FIG. 2), the bias current of the power section for memory 13*a* is set at a "high" level.

In addition, at a time of changing displayed pictures (and during non-displaying period), that is, when the memory write clock WCK and the memory write signal MAW are inputted to the display memory 12 (the period indicated as TD in FIG. 2), the bias current of the power section for memory 13*a* is set at a "middle" level. It is possible that the relation of the low bias current at the period TB in FIG. 2 and the middle bias current at the period TD in FIG. 2 may be reversed. It means that the relative level of the bias current at each period may vary corresponding to the driving capacity required at each step of memory-reading step and memory-writing step.

The semiconductor device of the first example of the present invention controls the bias current of the power section or memory 13*a* in response to the state signals of the access to the display memory 12 such as the memory-writing or memory-reading of the memory. In other words, when the memory is accessed, the driving capacity of the power RVDD for the memory is increased by stepping up the bias current and when the memory is not accessed, the driving capacity is decreased by stepping down the bias current. More specifically, when writing and reading the memory are simultaneously executed such as a time of changing displayed pictures or during displaying moving pictures, the bias current is increased. When the memory is not accessed such as during standby, the bias current is decreased to a standby level (e.g. ground level) to the contrary. In addition, when only writing or reading of the memory is executed, the level of the bias current is controlled according to the state.

The accessing period and non-accessing period to the memory can be clearly separated in a display device, for example, the period displaying still pictures, the period displaying moving pictures and the standby period. During the period when the memory is accessed, it is necessary to increase the driving capacity of the power for the memory to enable writing and reading the memory and the bias current should be set high enough to keep the capacity. However, during the period when the memory is not accessed, no driving capacity of the power for the memory is needed and therefore the bias current can be set relatively low.

The memory is not accessed during the standby state. And even during the displaying state of still pictures, the writing period to the memory is only before the start of display or at the beginning of the display. The standby state is kept long and the accessing period is short especially for a display device of a mobile device. Therefore, the power consumption can be reduced greatly by reducing the bias current during non-accessing period to the memory and thus it becomes possible to use the battery for a long time.

Example 2

Figure 4:
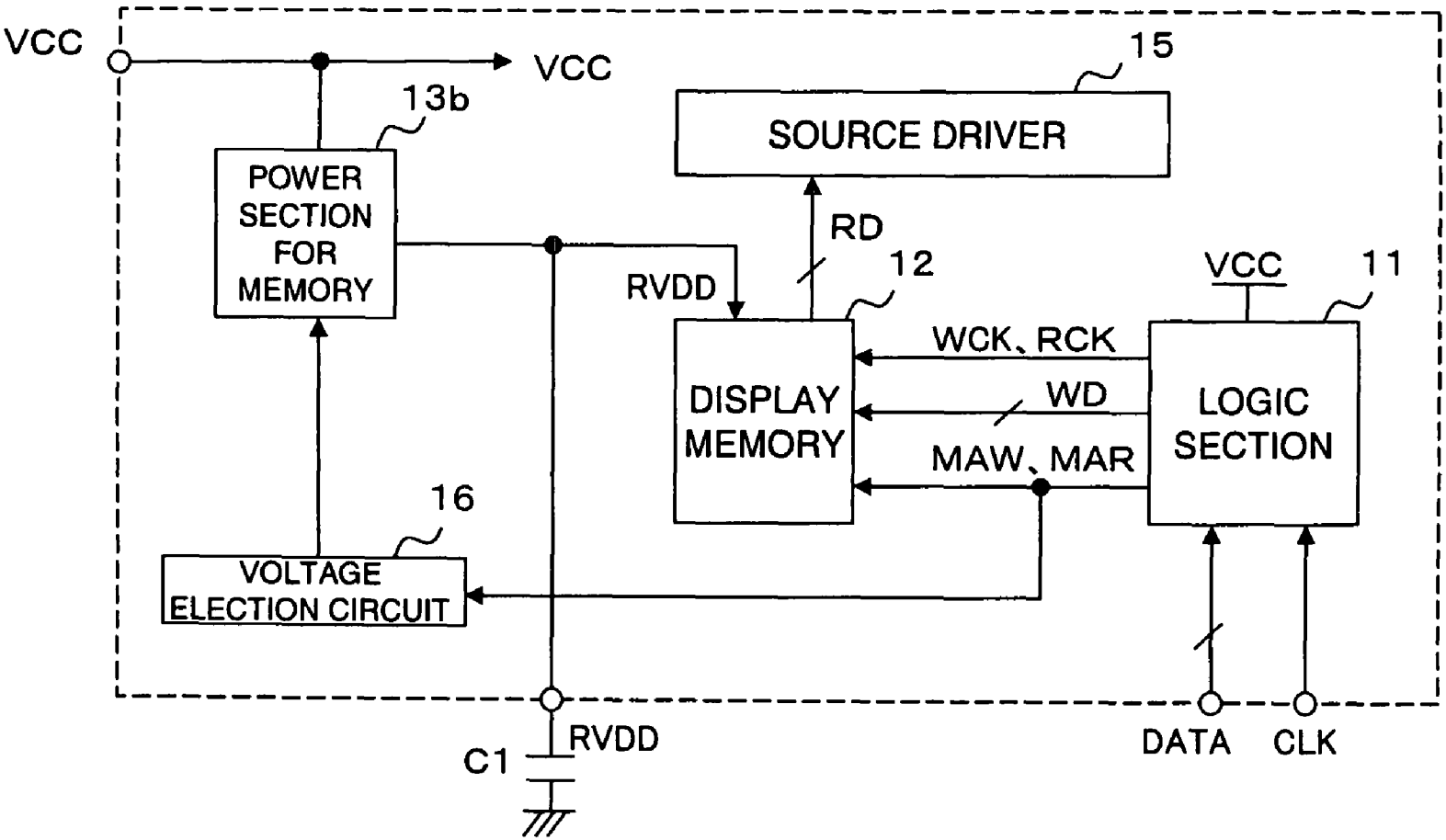
FIG. 4 is a schematic structural block diagram of a second example of a semiconductor device of the present invention.

FIG. 4 is a schematic structural block diagram of a second example of a semiconductor device of the present invention. In FIG. 4, the same symbols as those of FIG. 1 indicate the same matters and the explanation are omitted. The semiconductor device shown in FIG. 4 comprises a voltage selection circuit 16 instead of the bias circuit 14 of the semiconductor device shown in FIG. 1. The voltage selection circuit 16 detects the memory write signal MAW and the memory read signal MAR in the logic section 11 sent to the display memory 12 and controls the voltage of the power RVDD outputted from the power for memory 13*b* based on the results of the detection.

The power section for memory 13*b* is a circuit to generate the power RVDD for the display memory 12 from the power VCC and outputs the power RVDD. And it is configured that the voltage of the power RVDD can be varied by changing the setting of the voltage selection circuit 16.

Figure 5:
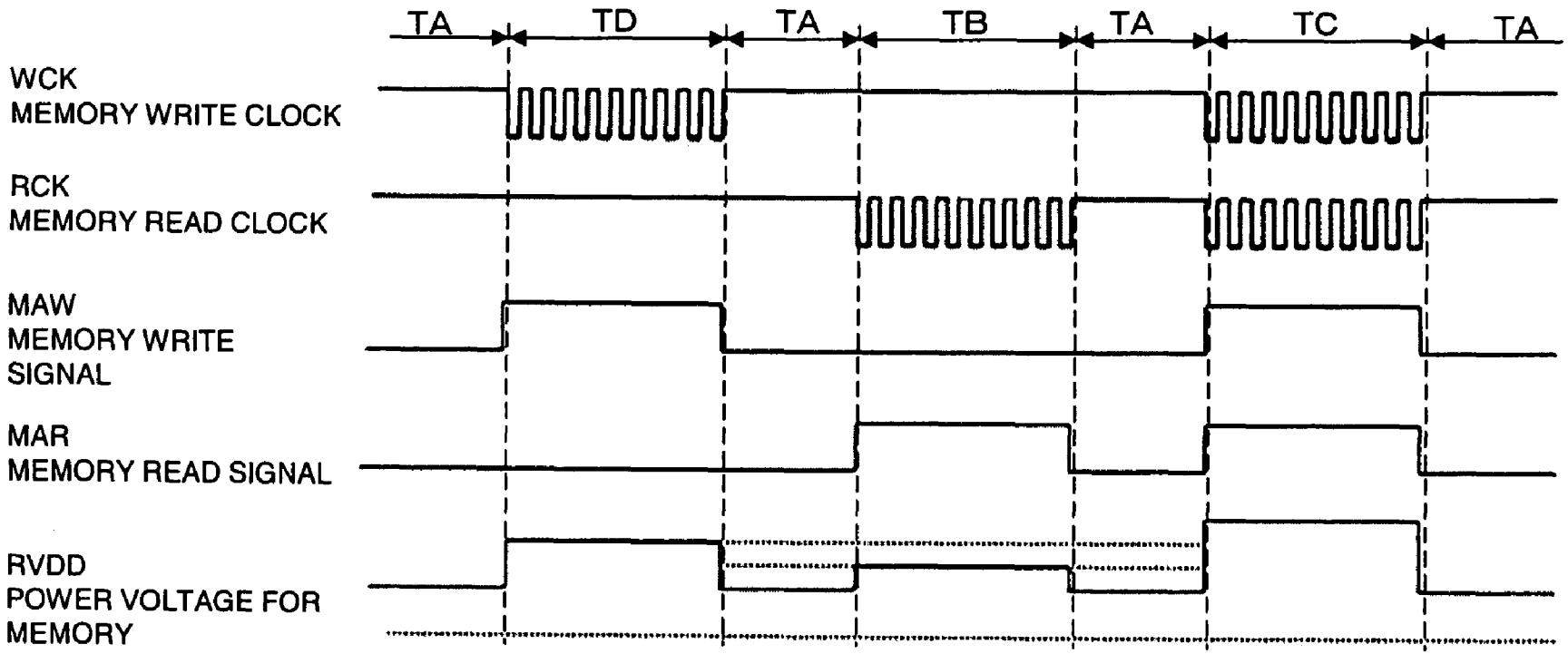
FIG. 5 is a timing chart showing an operation of a second example of a semiconductor device of the present invention.

FIG. 5 is a timing chart showing an operation of a second example of a semiconductor device of the present invention. FIG. 6 is a table showing an access state of a memory and a bias current at each operation state of a second example of a semiconductor device of the present invention.

The voltage selection circuit 16 sets the voltage of the power RVDD for the display memory 12 at a "minimum" level when the display memory 12 is during standby, that is, all of the memory write clock WCK, memory write signal MAW, memory read clock RCK and memory read signal MAR are not inputted to the display memory 12 (the period indicated as TA in FIG. 5) as shown in FIGS. 5 and 6.

When the display memory 12 is displaying a still picture, that is, when the memory read clock RCK and the memory read signal MAR are inputted to the display memory 12 (the period indicated as TB in FIG. 5), the voltage of the power RVDD for the display memory 12 is set at a "low" level.

On the other hand, when the display memory 12 is displaying moving pictures or at a time of changing displayed pictures (and during displaying period), that is, when all of the memory write clock WCK, memory write signal MAW, memory read clock RCK and memory read signal MAR are inputted to the display memory 12 (the period indicated as TC in FIG. 5), the voltage of the power RVDD for the display memory 12 is set at a "high" level.

In addition, at a time of changing displayed pictures (and during non-displaying period), that is, when the memory write clock WCK and the memory write signal MAW are inputted to the display memory 12 (the period indicated as TD in FIG. 5), the voltage of the power RVDD for the display memory 12 is set at a "middle" level. It is possible that the relation of the low voltage at the period TB in FIG. 5 and the middle voltage at the period TD in FIG. 5 may be reversed. It means that the relative level of the voltage at each period may vary corresponding to the voltage required at each step of memory-reading step and memory-writing step.

The semiconductor device of the second example of the present invention controls the voltage RVDD outputted from the power section or memory 13*b* in response to the state signals of the access to the display memory 12 such as the memory-writing or memory-reading of the memory. In other words, when the memory is accessed, the voltage outputted to the display memory 12 is set high by controlling the voltage selection circuit 16 and when the memory is not accessed, the voltage outputted to the display memory 12 is set low by controlling the voltage selection circuit 16. More specifically, when writing and reading the memory are simultaneously executed such as a time of changing displayed pictures or during displaying moving pictures, the voltage is set high. When the memory is not accessed such as during standby, the voltage is set minimum to the contrary. In addition, when only writing or reading of the memory is executed, the level of the voltage is controlled according to the state.

The accessing period and non-accessing period to the memory can be clearly separated in a display device, for example, the period displaying still pictures, the period displaying moving pictures and the standby period. During the period when the memory is accessed, it is necessary to increase the voltage of the power RVDD to the display memory 12 to enable writing and reading the memory and the power consumption in the display memory 12 is increased. However, during the period when the memory is not accessed, only a minimum voltage to maintain the state is needed and therefore a constant current in the display memory 12 can be decreased by setting the voltage of the power RVDD relatively low.

The memory is not accessed during the standby state. And even during the displaying state of still pictures, the writing period to the memory is only before start of the display or at the beginning of the display. The standby state is kept long and the accessing period is short especially for a display device of a mobile device. Therefore, the power consumption can be reduced greatly by reducing the constant current in the memory during non-accessing period to the memory and thus it becomes possible to use the battery for a long time.

The power consumption of the power circuit for the memory is reduced in the semiconductor device of Example 1. On the other hand the power consumption of the memory itself can be reduced in the semiconductor device of Example 2 by adapting the method of Example 1 to the voltage outputted from the power circuit.

The disclosures of all of the Patent Documents above mentioned are incorporated by reference. It should be noted that other objects, features and aspects of the present invention will become apparent in the entire disclosure and that modifications may be done without departing the gist and scope of the present invention as disclosed herein and claimed as appended herewith. Also it should be noted that any combination of the disclosed and/or claimed elements, matters and/or items may fall under the modification aforementioned.

What is claimed is:

1. A semiconductor device, comprising:

a display memory;

a logic circuit that controls the display memory; and a power circuit that supplies power to the display memory independently from a power supply for the logic circuit, wherein a driving voltage of the power circuit is configured to vary in response to an access state of the logic circuit to the display memory, the driving voltage comprising three or more values.

2. The semiconductor device as defined in claim 1, wherein the power circuit steps down a bias current when the display memory is not accessed compared to a case when the display memory is accessed.

3. The semiconductor device as defined in claim 2, further comprising a bias circuit that detects access signals of the logic circuit to the display memory, and controls a bias of the power circuit based on a result of the detection of the access signals.

4. The semiconductor device as defined in claim 3, wherein the bias circuit controls the bias of the power circuit to be at a minimum level when the display memory is in a standby mode.

5. The semiconductor device as defined in claim 3, wherein the bias circuit controls the bias of the power circuit to be at a low level when the display memory is in a still picture mode.

6. The semiconductor device as defined in claim 3, wherein the bias circuit controls the bias of the power circuit to be at a high level when the display memory is in a moving picture mode.

7. The semiconductor device as defined in claim 3, wherein the bias circuit controls the bias of the power circuit to be at a medium level when the display memory is in a changing displayed pictures mode in a non-displaying period.

8. The semiconductor device as defined in claim 3, wherein the bias circuit controls the bias of the power circuit to be at a high level when the display memory is in a changing displayed pictures mode in a displaying period.

9. The semiconductor device as defined in claim 1, wherein the power circuit steps down a power voltage to the display memory when the display memory is not accessed compared to a case when the display memory is accessed.

10. The semiconductor device as defined in claim 9, further, comprising a voltage selection circuit that detects the access signals of the logic circuit to the display memory, and controls a power voltage of the power circuit based on a result of the detection of the access signals.

11. A display device comprising the semiconductor device as defined in claim 1.

* * * * *